US008836238B2

(12) United States Patent
Gao et al.

(10) Patent No.: US 8,836,238 B2
(45) Date of Patent: Sep. 16, 2014

(54) DETECT METHOD FOR STEP DIMMING SELECTION

(75) Inventors: Wei Gao, Guangzhou (CN); Markus Heckmann, München (DE); Rene Twardzik, Traunreut (DE); Yanshun Xue, Guangzhou (CN)

(73) Assignee: Osram Gesellschaft mit beschraenkter Haftung, Munich (DE)

( * ) Notice: Subject to any disclaimer, the term of this patent is extended or adjusted under 35 U.S.C. 154(b) by 0 days.

(21) Appl. No.: 12/667,047

(22) PCT Filed: Jun. 12, 2008

(86) PCT No.: PCT/EP2008/057377

§ 371 (c)(1), (2), (4) Date: Apr. 15, 2010

(87) PCT Pub. No.: WO2009/003818

PCT Pub. Date: Jan. 8, 2009

(65) Prior Publication Data

US 2010/0213848 A1 Aug. 26, 2010

(30) Foreign Application Priority Data

Jun. 29, 2007 (CN) ..... 2007 1 0126327

(51) Int. Cl.
*H05B 37/02* (2006.01)
*H05B 41/298* (2006.01)

(52) U.S. Cl.
CPC ..... *H05B 41/2985* (2013.01)
USPC ..... 315/307; 315/86; 315/224

(58) Field of Classification Search
USPC ..... 315/86, 119, 224, 291, 307, 308
See application file for complete search history.

(56) References Cited

U.S. PATENT DOCUMENTS

| | | | | |
|---|---|---|---|---|
| 5,712,558 | A * | 1/1998 | Saint-Cyr et al. | 323/322 |
| 5,910,713 | A | 6/1999 | Nishi et al. | |
| 6,081,077 | A * | 6/2000 | Canova et al. | 315/307 |
| 6,211,623 | B1 * | 4/2001 | Wilhelm et al. | 315/224 |
| 6,429,603 | B1 * | 8/2002 | Tsugita et al. | 315/224 |
| 6,580,229 | B2 * | 6/2003 | Murakami et al. | 315/224 |
| 6,836,082 | B2 * | 12/2004 | Buij et al. | 315/308 |
| 7,015,652 | B2 * | 3/2006 | Shi | 315/224 |
| 7,154,232 | B2 * | 12/2006 | Contenti et al. | 315/225 |
| 2004/0263089 | A1 | 12/2004 | Contenti et al. | |
| 2005/0093457 | A1 * | 5/2005 | Hamblin | 315/86 |
| 2006/0006811 | A1 * | 1/2006 | Green et al. | 315/209 R |
| 2008/0253122 | A1 * | 10/2008 | Hancock et al. | 362/251 |

FOREIGN PATENT DOCUMENTS

| | | |
|---|---|---|
| CN | 1352520 A | 6/2002 |
| EP | 1309228 A2 | 5/2003 |

OTHER PUBLICATIONS

International Search Report of PCT/EP2008/057377 mailed on Sep. 8, 2008.
English abstract of CN1352520A, dated Jun. 5, 2002.

* cited by examiner

*Primary Examiner* — Tung X Le

(57) ABSTRACT

A detect method is provided for performing step dimming selection in an electronic ballast including an End of Lamp Life detect circuit and a half-bridge inverter, the End of Lamp Life detect circuit being connected to an input terminal of the control circuit, wherein each time when the power switch is turned on, it is judged whether the electronic ballast should enter the dimming mode or not by detecting the voltage at the input terminal of the control circuit before the half-bridge inverter starts operating.

7 Claims, 1 Drawing Sheet

DETECT METHOD FOR STEP DIMMING SELECTION

RELATED APPLICATIONS

The present application is a national stage entry according to 35 U.S.C. §371 of PCT application No.: PCT/EP2008/057377 filed on Jun. 12, 2008, which claims priority from Chinese application No.: 200710126327.3 filed on Jun. 29, 2007.

TECHNICAL FIELD

The invention relates to a new detect method for step dimming selection in an electronic ballast. The detect method provides enough information to the control IC to judge whether dimming mode should be active or not using the End of Lamp Life (EOLL) detect circuit.

BACKGROUND OF THE INVENTION

As is well-known, when the life of a fluorescent lamp comes to an end, the ballast makes the lamp work continuously, thus causing over-heat of the lamp and generating discharge "smog", meanwhile, a very high voltage is generated at the cathode of the lamp to put the lamp and the ballast in an abnormal and dangerous state. Therefore, the End of Lamp Life detect circuit is more and more widely used in the electronic ballast controlled by an Application Specific Integrated Circuit (ASIC) or a Microcontroller.

Meanwhile, reducing the output power of the high-performance electronic ballast when full output is unnecessary can not only functions to save energy and prolong the lifetime of the lamp, but also change the visual effect. Thus it is particularly meaningful to integrate a dimming selection function in the electronic ballast in this time when energy saving is gaining more and more attention.

However, in order to simultaneously achieve the above two functions in the electronic ballast, by use of the existing known circuits, there is no other choice but to integrate the two kinds of protection circuits at the same time, this not only increases the cost, but also requires complicated circuits that include a lot of elements and components.

SUMMARY OF THE INVENTION

It is, therefore, a technical problem to be solved by the present invention to achieve the functions of End of Lamp Life protection and dimming selection simultaneously in an electronic ballast in a cheap, simple and reliable way.

To solve this technical problem, the basic concept of the technical solution adopted by the invention is that it is judged whether the electronic ballast should enter the dimming mode or not by detecting the voltage at the input terminal of the control circuit of the electronic ballast.

In an electronic ballast comprising a half-bridge inverter and End of Lamp Life detect circuit, the End of Lamp Life detect circuit is connected to an input terminal of the control circuit, each time when the power switch is turned on, it is judged whether the electronic ballast should enter the dimming mode or not by detecting the voltage at the input terminal of the control circuit before the half-bridge inverter starts operating.

According to one aspect of the invention, if the voltage detected at the input terminal of the control circuit before the half-bridge inverter starts operating is higher than a comparison threshold value, the dimming mode should be active.

According to another aspect of the invention, the comparison threshold value is preferably equal to the comparison threshold value of the End of Lamp Life detect circuit. Theoretically, the comparison threshold value can be any threshold value below the stable voltage under normal operation and above zero. The comparison threshold value can be chosen to be between +25V and −25V.

According to still another aspect of the invention, the End of Lamp Life detect circuit is a mean value filter for detecting the asymmetrical voltages across the fluorescent lamp.

According to yet another aspect of the invention, the control circuit can be an Application Specific Integrated Circuit or a Microcontroller.

The detect method of the present invention can also be used for emergency lighting system. Analogously, when there is a power interruption and a power recovery by the back-up power source, the electronic ballast is caused to make a correct response by detecting the voltage at the input of the control circuit before the half-bridge inverter starts operating.

The advantages of the detect method of the present invention are as follows:

1. Only one power switch is needed to control the electronic ballast on/off and full output mode/dimming mode.
2. The detect method does not add any additional component to realize a new function.
3. No additional pin is requested to realize this dimming mode selection function because it is combined with EOLL detect pin if a control ASIC is used to control the ballast.
4. No additional input port is requested to realize this dimming mode selection function because it is combined with EOLL detect input port if a Microcontroller is used to control the ballast.
5. No additional control switch or hardware is requested to give some information to the control circuit, but the primary power switch which is necessary for all ballast.

BRIEF DESCRIPTION OF THE DRAWINGS

The invention will be better appreciated by the descriptions of the embodiments with reference to the figures, wherein.

DETAILED DESCRIPTION

Figure 1:
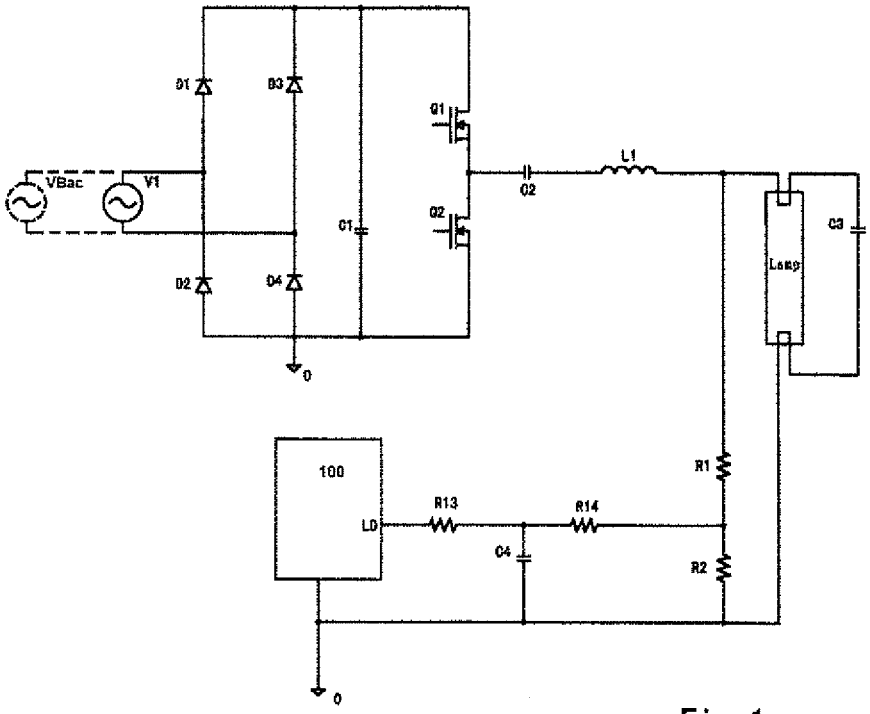
FIG. 1 shows a typical circuit for fluorescent lamp ballast including a half-bridge inverter and EOLL detect circuit.

FIG. 1 shows a typical circuit for fluorescent lamp ballast including a half-bridge inverter and EOLL detect circuit.

Figure 2:
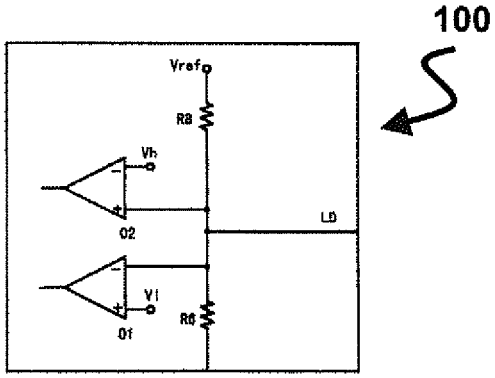
FIG. 2 shows a typical circuit within the control Integrated Circuit.

In FIG. 1, resistors R1, R2, R14 and capacitor C4 form an EOLL detect circuit that is a mean value filter detecting the asymmetrical voltage across the fluorescent lamp and connecting to an input terminal LD of the control circuit 100 (for example an ASIC). The typical circuit of the part of the control is show in FIG. 2. To achieve the function of EOLL detection, the voltage levels of the input terminal LD of the control circuit 100 and capacitor C4 are very similar during operation of the control circuit 100, and this can be realized by optimizing the parameters of the components. In the text below, voltage of the input terminal LD of the control circuit 100 always means the voltage of the input terminal LD and the voltage of capacitor C4.

During normal operation, the voltage level of the input terminal LD is close to ½ Vref. When the power supply to the ballast is cut by turning off the power switch, the ballast would stop running and no voltage is given by reference voltage Vref. Then the voltage level of the input terminal LD would drop and the time constant is a function of the capacitance of the capacitor C4 and the resistance of resistors R1, R2, R6 and R8.

It shall be noted that the OFF TIME is the time interval of the power switch from being turned off to being turned on, and said OFF TIME is associated with the voltage level of the input terminal LD of the control circuit 100 before the half-bridge inverter starts operating. Besides, the OFF TIME can show the desire of the user in making the ballast enter full power mode or dimming mode. Therefore, each time the power switch is turned on, the control circuit 100 should detect the voltage level of the input terminal LD before the half-bridge inverter starts operating to get the information about the OFF TIME.

The control circuit 100 can recognize the OFF TIME by detecting the voltage level of the input terminal LD before the half-bridge inverter starts operating to judge if the ballast should enter the dimming mode or not. For example, if the voltage on LD is higher than a comparison threshold value, dimming mode should be active and vice verse. Preferably, the comparison threshold value can be equal to the comparison threshold value of the EOLL detect circuit so as to save cost. Theoretically, the comparison threshold value can be any threshold value below the stable voltage under normal operation and above zero. But appropriate values will be specified in view of cost and application. If the range of the comparison threshold value should be specified, it should be between +25V and −25V.

In addition, the detect method of the invention can not only be used for step dimming, but also for emergency lighting system.

In the safety rules of some European countries, special requirements are set for the ballast used in emergency lighting system. That is, at a time of power interruption and recovery of power by back-up power supply (VBac), the light source should emit light within 0.5 second. The detect method of the present invention can detect this process of quick recovery after power interruption, thereby making the internal control circuit to respond correctly.

While the invention has been described in conjunction with specific embodiments, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A detect method for performing step dimming selection in an electronic ballast including an End of Lamp Life (EOLL) detect circuit, the EOLL detect circuit being connected to an input terminal of a control circuit, wherein each time when a power switch is turned on, the voltage is detected at the input terminal of the control circuit before the half-bridge inverter starts operating and wherein if the voltage detected at the input terminal of the control circuit is higher than a comparison threshold value, a dimming mode is activated, wherein in the dimming mode, the lamp is operated at an output between off and full output.

2. The detect method according to claim 1, wherein the comparison threshold value is equal to the comparison threshold value of the EOLL detect circuit.

3. The detect method according to claim 1, wherein the comparison threshold value being any threshold value below a stable voltage under normal operation and above zero.

4. The detect method according to claim 1, wherein the comparison threshold value is chosen to be between +25V and −25V.

5. The detect method according to claim 1, wherein the EOLL detect circuit is a mean value filter for detecting the asymmetrical voltages across the fluorescent lamp.

6. The detect method according to claim 1, wherein the control circuit is an Application Specific Integrated Circuit (ASIC) or a microcontroller.

7. A detect method for use in an emergency light system, having an electronic ballast including an EOLL detect circuit and a half-bridge inverter, the EOLL detect circuit being connected to an input terminal of a control circuit, wherein at a time of power interruption and power recovery by back-up power supply, the control circuit is made to respond correctly by detecting the voltage at the input terminal of the control circuit before the half-bridge inverter starts operating and wherein if the voltage detected at the input terminal of the control circuit is higher than a comparison threshold value, a dimming mode is activated, wherein in the dimming mode, the lamp is operated at an output between off and full output.

* * * * *